US009747860B2

(12) United States Patent
Lee et al.

(10) Patent No.: US 9,747,860 B2
(45) Date of Patent: Aug. 29, 2017

(54) METHOD OF DRIVING DISPLAY PANEL AND DISPLAY APPARATUS FOR PERFORMING THE SAME

(71) Applicant: Samsung Display Co., Ltd., Yongin (KR)

(72) Inventors: Sang-Ik Lee, Seoul (KR); Joon-Chul Goh, Hwaseong-si (KR); Jung-Won Kim, Seoul (KR); Hong-Soo Kim, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 493 days.

(21) Appl. No.: 14/187,810

(22) Filed: Feb. 24, 2014

(65) Prior Publication Data

US 2015/0070405 A1 Mar. 12, 2015

(30) Foreign Application Priority Data

Sep. 11, 2013 (KR) ..... 10-2013-0108884

(51) Int. Cl.

| | |
|---|---|
| ***G09G 5/10*** | (2006.01) |
| ***G09G 3/36*** | (2006.01) |
| ***G09G 3/20*** | (2006.01) |

(52) U.S. Cl.

CPC ..... *G09G 3/3696* (2013.01); *G09G 3/2018* (2013.01); *G09G 3/2081* (2013.01); *G09G 3/3614* (2013.01); *G09G 2320/028* (2013.01); *G09G 2320/0261* (2013.01); *G09G 2320/0276* (2013.01)

(58) Field of Classification Search

CPC .. G09G 3/3696; G09G 3/2081; G09G 3/2018; G09G 3/3614; G09G 2320/0276; G09G 2320/028; G09G 2320/0261

See application file for complete search history.

(56) References Cited

U.S. PATENT DOCUMENTS

| | | | | |
|---|---|---|---|---|
| 7,688,295 | B2 | 3/2010 | Hsu et al. | |
| 7,764,294 | B2 | 7/2010 | Lee | |
| 7,800,597 | B2 | 9/2010 | Hong | |
| 8,174,515 | B2 | 5/2012 | Jeong et al. | |
| 8,339,425 | B2 | 12/2012 | Shin et al. | |
| 8,368,629 | B2 | 2/2013 | Jung et al. | |
| 2003/0151584 | A1* | 8/2003 | Song | G09G 3/3607 345/100 |
| 2006/0238472 | A1* | 10/2006 | Lee | G09G 3/3688 345/89 |
| 2008/0136761 | A1 | 6/2008 | Hong et al. | |

(Continued)

FOREIGN PATENT DOCUMENTS

JP 2011-7889 1/2011

*Primary Examiner* — Matthew Sim

(74) *Attorney, Agent, or Firm* — H.C. Park & Associates, PLC

(57) ABSTRACT

A method of driving a display panel includes generating a high data voltage having a high gamma corresponding to a grayscale of input image data, generating a low data voltage having a low gamma less than the high gamma corresponding to the grayscale of the input image data and outputting the high data voltage and the low data voltage to pixels of a display panel. Of the high data voltage and the low data voltage, only the low data voltage is outputted to the pixels of the display panel during at least one frame.

18 Claims, 11 Drawing Sheets

(56) References Cited

U.S. PATENT DOCUMENTS

| | | | | |
|---|---|---|---|---|
| 2008/0218463 | A1 | 9/2008 | Lee et al. | |
| 2009/0262106 | A1 | 10/2009 | Lu et al. | |
| 2010/0007639 | A1* | 1/2010 | Jeong ..... | G09G 3/2007 345/208 |

* cited by examiner

| | |
|---|---|
| PA | PB |
| PB | PA |

METHOD OF DRIVING DISPLAY PANEL AND DISPLAY APPARATUS FOR PERFORMING THE SAME

CROSS REFERENCE TO RELATED APPLICATION

This application claims priority from and the benefit of Korean Patent Application No. 10-2013-0108884, filed on Sep. 11, 2013, which is hereby incorporated by reference for all purposes as if fully set forth herein.

BACKGROUND

Field

Exemplary embodiments of the present invention relate to a method of driving a display panel and a display apparatus for performing the method. More particularly, exemplary embodiments of the present invention relate to a method of driving a display panel for improving a display quality and a display apparatus for performing the method.

Discussion of the Background

Generally, a liquid crystal display ("LCD") apparatus includes a first substrate including a pixel electrode, a second substrate including a common electrode and a liquid crystal layer disposed between the first and second substrate. An electric field is generated by voltages applied to the pixel electrode and the common electrode. By adjusting a magnitude of the electric field, a transmittance of a light passing through the liquid crystal layer may be adjusted so that a desired image may be displayed.

LCD devices are advantageous because the LCD device may be formed to be thin. However, LCD devices have the disadvantage of a narrow viewing angle. To improve the viewing angle, LCD panels having a patterned vertical alignment (PVA) mode or a super patterned vertical alignment (S-PVA) mode have been developed.

The LCD panel having the PVA or S-PVA mode includes two subpixels having grayscales different from each other in a unit pixel. Different voltages are respectively applied to the subpixels so that a side grayscale band or a grayscale inversion may be improved and a side visibility may be improved.

However, it is difficult to adjust light transmittances of two subpixels. Further, the aperture ratio of the display panel may decrease in the PVA or S-PVA mode.

Thus, a time divisional driving method in which different voltages are applied to a single pixel during each frame has been developed to replace a method in which a single pixel is divided into two subpixels.

However, when a high gamma period and a low gamma period is divided in the same duration in the time divisional driving method, the side visibility may not be sufficiently improved due to a difference in velocities of rising and falling responses of the liquid crystal.

Further, when an object is displaced in a direction in an image, a moving checker artifact generating a display artifact having a check shape may be displayed due to a difference of luminances of pixels shown in different view points.

SUMMARY OF THE INVENTION

Exemplary embodiments of the present invention provide a method of driving a display panel capable of improving a display quality by improving a side visibility and preventing moving checker artifacts.

Exemplary embodiments of the present invention also provide a display apparatus configured to perform the above-mentioned method.

Additional features of the invention will be set forth in the description which follows, and in part will be apparent from the description, or may be learned by practice of the invention.

An exemplary embodiment of the present invention discloses a method of driving a display panel. The method includes generating a high data voltage having a high gamma corresponding to a grayscale of input image data, generating a low data voltage having a low gamma less than the high gamma corresponding to the grayscale of the input image data and outputting the high data voltage and the low data voltage to pixels of a display panel. Only the low data voltage is outputted to the pixels of the display panel during at least one frame.

An exemplary embodiment of the present invention also discloses a display apparatus including a data driver and a display panel. The data driver generates a high data voltage having a high gamma corresponding to a grayscale of input image data and a low data voltage having a low gamma less than the high gamma corresponding to the grayscale of the input image data. The display panel includes pixels to which the high data voltage and the low data voltage are applied. Only the low data voltage is applied to the pixels of the display panel during at least one frame.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
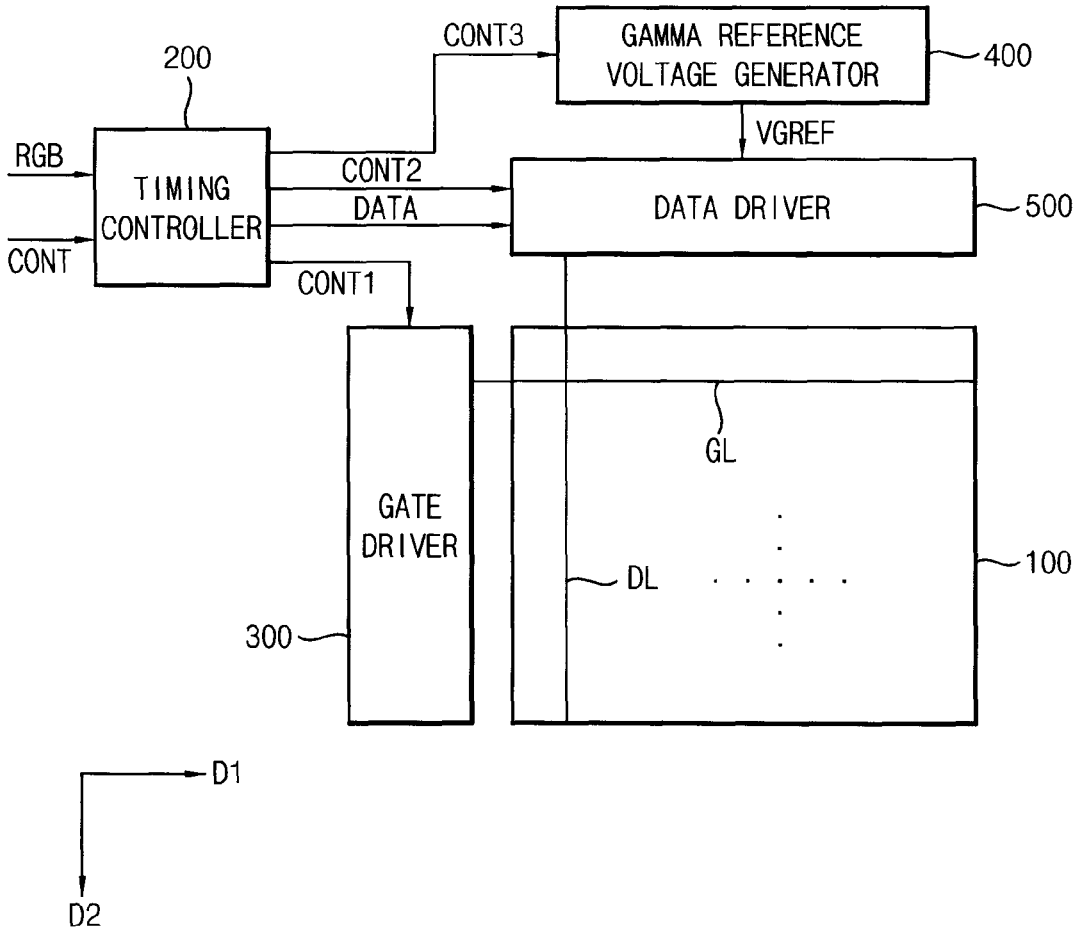
FIG. 1 is a block diagram illustrating a display apparatus according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

FIG. 1 is a block diagram illustrating a display apparatus according to an exemplary embodiment of the present invention.

Referring to FIG. 1, the display apparatus includes a display panel 100 and a panel driver. The panel driver includes a timing controller 200, a gate driver 300, a gamma reference voltage generator 400, and a data driver 500.

The display panel 100 has a display region that may display an image, and a peripheral region adjacent to the display region.

The display panel 100 includes a plurality of gate lines GL, a plurality of data lines DL, and a plurality of pixels (not shown) connected to the gate lines GL and the data lines DL. The gate lines GL extend in a first direction D1 and the data lines DL extend in a second direction D2 crossing the first direction D1.

Each pixel includes a switching element (not shown), a liquid crystal capacitor (not shown) and a storage capacitor (not shown). The liquid crystal capacitor and the storage capacitor are electrically connected to the switching element. The unit pixels may be disposed in a matrix.

The timing controller 200 receives input image data RGB and an input control signal CONT from an external apparatus (not shown). The input image data may include red image data R, green image data G, and blue image data B. However, image data for other colors may be included. The input control signal CONT may include a master clock signal and a data enable signal. The input control signal CONT may also include a vertical synchronizing signal and a horizontal synchronizing signal.

The timing controller 200 generates a first control signal CONT1, a second control signal CONT2, a third control signal CONT3, and a data signal DATA based on the input image data RGB and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data RGB. The timing controller 200 outputs the data signal DATA to the data driver 500.

The timing controller 200 may generate a high data signal having a high gamma based on the input image data RGB. The timing controller 200 may generate a low data signal having a low gamma based on the input image data RGB. The timing controller may selectively output the high data signal and the low data signal to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the timing controller 200. The gate driver 300 sequentially outputs the gate signals to the gate lines GL.

The gate driver 300 may be directly disposed on the display panel 100, or may be connected to the display panel 100 as a tape carrier package ("TCP") type. Alternatively, the gate driver 300 may be integrally formed with the display panel 100.

The gamma reference voltage generator 400 generates a gamma reference voltage VGREF in response to the third control signal CONT3 received from the timing controller 200. The data driver 500 receives gamma reference voltage VGREF from gamma reference voltage generator 400. The gamma reference voltage VGREF has a value corresponding to a magnitude of the data signal DATA.

The gamma reference voltage generator 400 may provide a high gamma reference voltage to the data driver 500 using a high gamma curve. The gamma reference voltage generator 400 may provide a low gamma reference voltage to the data driver 500 using a low gamma curve.

According to exemplary embodiments, the gamma reference voltage generator 400 may be disposed in the timing controller 200, in the data driver 500, as a stand-alone component, etc.

The data driver 500 receives the second control signal CONT2 and the data signal DATA from the timing controller 200, and receives the gamma reference voltages VGREF from the gamma reference voltage generator 400. The data driver 500 converts the data signal DATA into analog-type data voltages using the gamma reference voltages VGREF. The data driver 500 sequentially outputs the data voltages to the data lines DL.

The data driver 500 may convert the high data signal into a high data voltage using the high gamma reference voltage. The data driver 500 may convert the low data signal into a low data voltage using the low gamma reference voltage. The data driver 500 may selectively output the high data voltage and the low data voltage to the pixel according to a frame.

The data driver 500 may include a shift register (not shown), a latch (not shown), a signal processing part (not shown), and a buffer part (not shown). The shift register may output a latch pulse to the latch. The latch may temporally store the data signal DATA. The latch may output the data signal DATA to the signal processing part. The signal processing part may generate an analog type data voltage based on the digital type data signal and the gamma reference voltage VGREF. The signal processing part outputs the data voltage to the buffer part. The buffer part compensates the data voltage to have a uniform level. The buffer part outputs the compensated data voltage to the data line DL.

The data driver 500 may be directly disposed on the display panel 100, or may be connected to the display panel 100 in a TCP type. Alternatively, the data driver 500 may be integrally formed with the display panel 100.

In exemplary embodiments, the timing controller 200, gate driver 300, gamma reference voltage generator 400, and data driver 500, and/or one or more components thereof, may be implemented via one or more general purpose and/or special purpose components, such as one or more discrete circuits, digital signal processing chips, integrated circuits, application specific integrated circuits, microprocessors, processors, programmable arrays, field programmable arrays, instruction set processors, and/or the like.

According to exemplary embodiments, the features, functions, processes, etc., described herein may be implemented via software, hardware (e.g., general processor, digital signal processing (DSP) chip, an application specific integrated circuit (ASIC), field programmable gate arrays (FPGAs), etc.), firmware, or a combination thereof. In this manner, the timing controller 200, gate driver 300, gamma reference voltage generator 400, and data driver 500, and/or one or more components thereof may include or otherwise be associated with one or more memories (not shown) including code (e.g., instructions) configured to cause the timing controller 200, gate driver 300, gamma reference voltage generator 400, and data driver 500, and/or one or more components thereof to perform one or more of the features/functions/processes described herein.

The memories may be any medium that participates in providing code to the one or more software, hardware, and/or firmware components for execution. Such memories may be implemented in any suitable form, including, but not limited to, non-volatile media, volatile media, and transmission media. Non-volatile media include, for example, optical or magnetic disks. Volatile media include dynamic memory. Transmission media include coaxial cables, copper wire and fiber optics. Transmission media can also take the form of acoustic, optical, or electromagnetic waves. Common forms of computer-readable media include, for example, a floppy disk, a flexible disk, hard disk, magnetic tape, any other magnetic medium, a compact disk-read only memory (CD-ROM), a rewriteable compact disk (CDRW), a digital video disk (DVD), a rewriteable DVD (DVD-RW), any other optical medium, punch cards, paper tape, optical mark sheets, any other physical medium with patterns of holes or other optically recognizable indicia, a random-access memory (RAM), a programmable read only memory (PROM), and erasable programmable read only memory (EPROM), a FLASH-EPROM, any other memory chip or cartridge, a carrier wave, or any other medium from which information may be read by, for example, a controller/processor.

Figure 2:
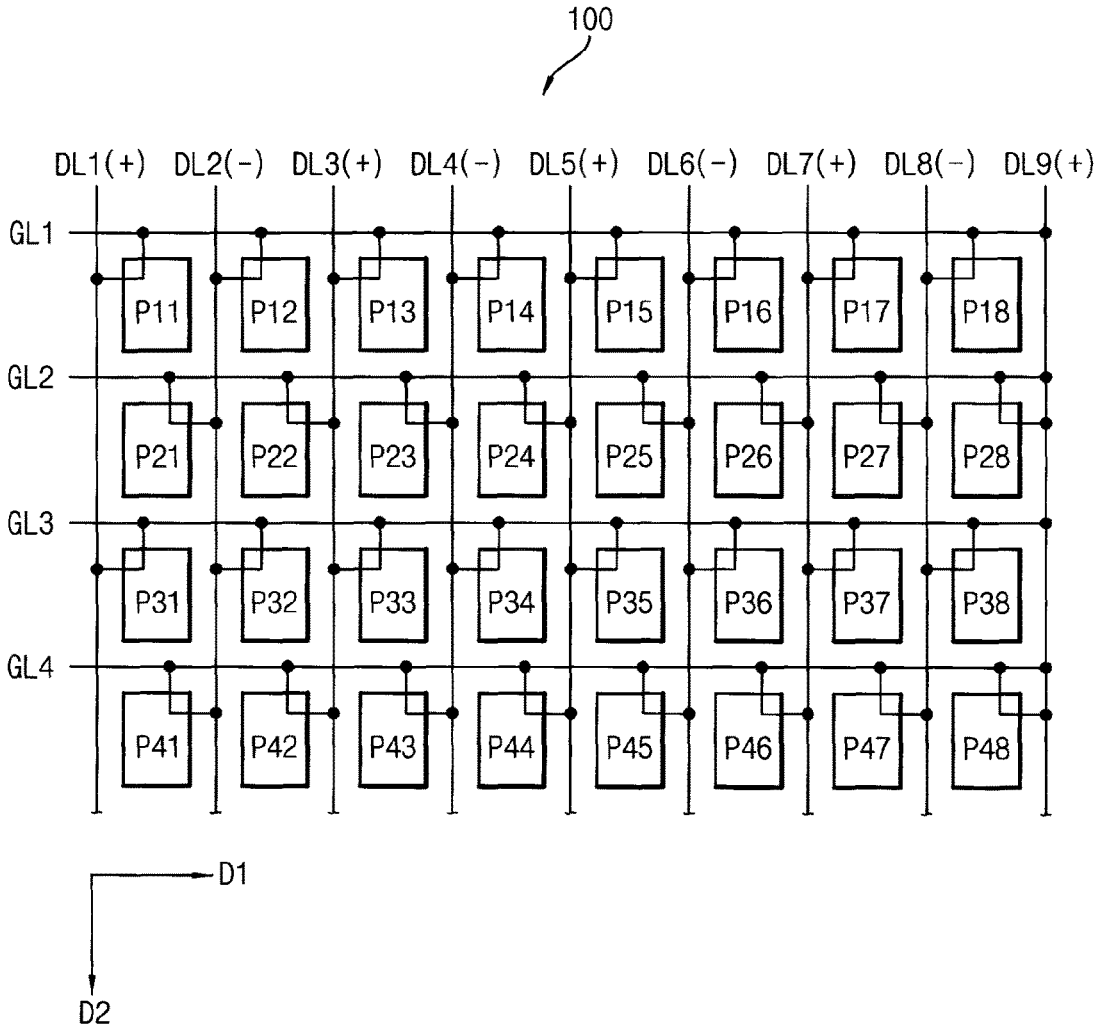
FIG. 2 is a plan view illustrating a pixel array of a display panel of FIG. 1.

FIG. 2 is a plan view illustrating a pixel array of the display panel 100 of FIG. 1.

Referring to FIGS. 1 and 2, the display panel 100 has an alternate pixel array. That is, the data lines of the display panel 100 are alternately connected to the pixels in adjacent pixel columns.

Pixels P11 to P18 in a first pixel row are connected to a first gate line GL1. Pixels P21 to P28 in a second pixel row are connected to a second gate line GL2. Pixels P31 to P38 in a third pixel row are connected to a third gate line GL3. Pixels P41 to P48 in a fourth pixel row are connected to a fourth gate line GL4.

Pixels P11, P21, P31 and P41 in a first pixel column are alternately connected to a first data line DL1 and a second data line DL2. Pixels P12, P22, P32 and P42 in a second pixel column are alternately connected to the second data line DL2 and a third data line DL3. Pixels P13, P23, P33 and P43 in a third pixel column are alternately connected to the third data line DL3 and a fourth data line DL4. Pixels P14, P24, P34 and P44 in a fourth pixel column are alternately connected to the fourth data line DL4 and a fifth data line DL5.

Data voltages having a positive polarity are applied to the first, third, fifth, seventh and ninth data lines DL1, DL3, DL5, DL7 and DL9. Data voltages having a negative polarity are applied to the second, fourth, sixth and eighth data lines DL2, DL4, DL6 and DL8. Thus, the pixels in the display panel 100 may be inverted in a unit of one dot according to the first and second directions D1 and D2. The polarity of the data voltages of the first to ninth data lines DL1 to DL9 may be inverted every two frames.

Figures 3, 4A:
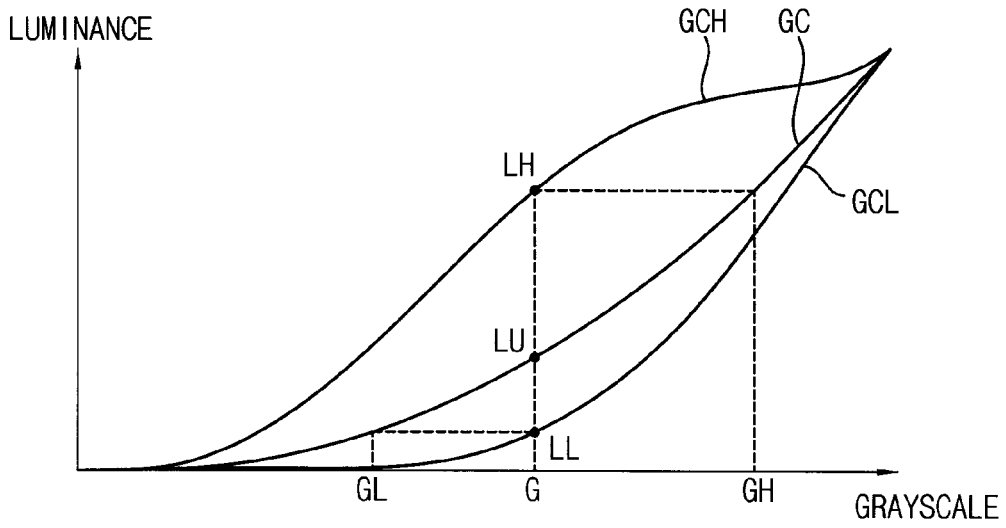
FIG. 3 is a graph illustrating a gamma curve of a gamma voltage generator of FIG. 1.
FIG. 4A is a plan view illustrating a pixel group of the display panel of FIG. 1.

FIG. 3 is a graph illustrating a gamma curve of the gamma voltage generator 400 of FIG. 1.

Referring to FIGS. 1, 2, and 3, a gamma curve GC represents luminances of the pixel according to the grayscales, which correspond to average values of luminances in a high frame and luminances in a low frame for the same pixel. A high pixel gamma curve GCH represents luminances of the pixel according to the grayscales in the high frame. A low pixel gamma curve GCL represents luminances of the pixel according to the grayscales in the low frame.

For example, the luminance value displayed in the pixel according to the grayscale G may be the luminance LU using the gamma curve GC. To display the luminance LU in the pixel corresponding to the grayscale G, the pixel represents the luminance LH in the high frame and the pixel represents the luminance LL in the low frame.

The grayscale value of the high frame to display the luminance LH is the grayscale GH using the gamma curve GC. The grayscale value of the low frame to display the luminance LL is the grayscale GL using the gamma curve GC.

The gamma reference voltage generator 400 may generate the high gamma reference voltage and the low gamma reference voltage using the grayscale GH of the high frame and the grayscale GL of the low frame.

The data driver 500 generates the high data voltage and the low data voltage using the high gamma reference voltage and the low gamma reference voltage. The data driver 500 outputs the high data voltage and the low data voltage to the display panel 100.

The data driver 500 may output only the low data voltages to the pixels of the display panel 100 during at least one frame.

An average of a front gamma of the high data voltage and a front gamma of the low data voltage may be substantially the same as a front gamma of the input image data.

Figure 4B:
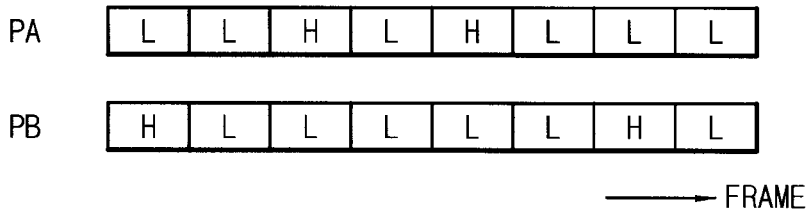
FIGS. 4B and 4C are conceptual diagrams illustrating a sequence of output image data applied to the pixel group of FIG. 4A.
Figure 4C:
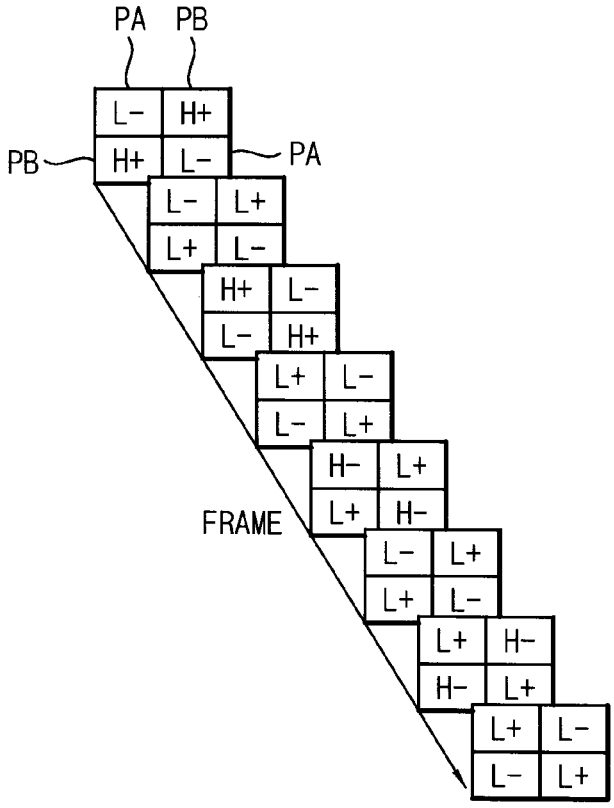
Figure 5:
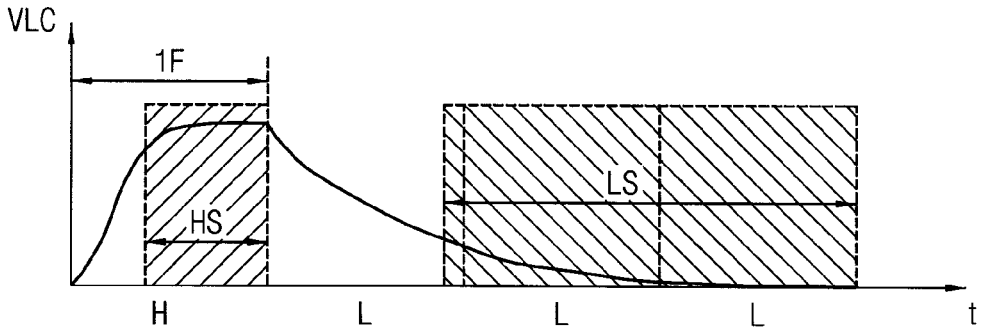
FIG. 5 is a timing diagram illustrating a pixel voltage charged to a liquid crystal of the pixel of the display panel of FIG. 1.

FIG. 4A is a plan view illustrating a pixel group of the display panel 100 of FIG. 1. FIGS. 4B and 4C are conceptual diagrams illustrating a sequence of output image data applied to the pixel group of FIG. 4A. FIG. 5 is a timing diagram illustrating a pixel voltage charged to a liquid crystal of the pixel of the display panel 100 of FIG. 1.

Referring to FIGS. 1 to 5, the display panel 100 includes a pixel group including four pixels in a two by two matrix.

In an exemplary embodiment, the pixel group includes a first pixel PA in a first row and a first column, a second pixel PB in the first row and a second column which is adjacent to the first pixel PA in the first direction D1. The pixel group further includes a third pixel PB in a second row and the first column which is adjacent to the first pixel PA in the second direction D2 and a fourth pixel PA in the second row and the second column which is adjacent to the second pixel PB in the second direction D2.

In an exemplary embodiment, the voltage having the same pattern is applied to the first pixel and the fourth pixel so that the first pixel and the fourth pixel are explained using the same reference PA. In an exemplary embodiment, the voltage having the same pattern is applied to the second pixel and the third pixel so that the second pixel and the third pixel are explained using the same reference PB.

When the high data voltage is applied to the first pixel, the high data voltage is applied to the fourth pixel. When the low data voltage is applied to the first pixel, the low data voltage is applied to the fourth pixel. The first pixel and the fourth pixel form a data pixel group.

Although not shown in figures, when the high voltage is applied to the first pixel, the pixels to which the high data voltage is applied may be in the data pixel group same as the first pixel.

When the high data voltage is applied to the second pixel, the high data voltage is applied to the third pixel. When the low data voltage is applied to the second pixel, the low data voltage is applied to the third pixel. The second pixel and the third pixel form a data pixel group.

Although not shown in figures, when the high voltage is applied to the second pixel, the pixels to which the high data voltage is applied may be in the same data pixel group as the second pixel.

Referring to FIG. 2, the display panel 100 has an alternate pixel array. For example, a first data line is connected to the first pixel PA in the pixel group. A second data line is connected to the second pixel PB and the third pixel PB in the pixel group. A third data line is connected to the fourth pixel PA in the pixel group.

Referring to FIG. 4B, a high data voltage H is applied to the first to fourth pixels PA and PB during a frame. However, a low data voltage L is applied to the first to fourth pixels PA and PB during three out of every four frames.

A rising response of a liquid crystal is relatively fast but a falling response of the liquid crystal is relatively slow. Thus, when the number of the high frames during which the high data voltage H is applied to the pixels and the number of the low frames during which the low data voltage L is applied to the pixels are same, the low data voltage L is not sufficiently displayed. Therefore, a side visibility may not be sufficiently improved.

In FIG. 5, a duration when the high data voltage is substantially displayed to a viewer is represented as HS and a duration when the low data voltage is substantially displayed to the viewer is represented as LS. In the present exemplary embodiment, a ratio between the number of high frames and the number of low frames is 1:3, so that the low data voltage L may be sufficiently displayed to the viewer although the falling response of the liquid crystal is relatively slow.

The high data voltage H and the low data voltage L pattern applied to the first to fourth pixels PA and PB repeats every eight frames.

In an example, referring again to FIGS. 4B and 4C, the low data voltage L is applied to the first and fourth pixels PA during first, second, fourth, sixth, seventh, and eighth frames, and the high data voltage H is applied to the first and fourth pixels PA during third and fifth frames. During the first to eighth frames, the data voltages having a sequence of L, L, H, L, H, L, L, L are applied to the first and fourth pixels PA.

The low data voltage L is applied to the second and third pixels PB during second, third, fourth, fifth, sixth and eighth frames and the high data voltage H is applied to the second and third pixels PB during first and seventh frames. During the first to eighth frames, the data voltages having a sequence of H, L, L, L, L, L, H, L are applied to the second and third pixels PB.

Only the low data voltage L is applied to the pixels PA and PB of the display panel 100 during at least one frame of the sequence. In FIG. 4C, during the first frame and the third frame, the high data voltage H and the low data voltage L are selectively applied to the pixels of the display panel 100. During the second frame and the fourth frame, the low data voltage L is simultaneously applied to the pixels of the display panel 100.

In the present exemplary embodiment, when the second and third pixels PB form a first data pixel group and the first and fourth pixels PA form a second data pixel group, the high data voltage H is applied to the first data pixel group of the display panel 100 and the low data voltage L is applied to the second data pixel group of the display panel 100 during the first frame.

During a second frame, the low data voltage L is applied to the first data pixel group and the second data pixel group of the display panel 100.

During a third frame, the low data voltage L is applied to the first data pixel group of the display panel 100 and the high data voltage H is applied to the second data pixel group of the display panel 100 during the first frame.

During a fourth frame, the low data voltage L is applied to the first data pixel group and the second data pixel group of the display panel 100.

The first to fourth pixels PA and PB may be inverted every two frames.

Referring to FIG. 4C, the data voltages having a sequence of L−, L−, H+, L+, H−, L−, L+, L+ are applied to the first and fourth pixels PA, during the first to eighth frames, respectively. During an eight frame sequence, the number of the data voltages of L− may be three, the number of the data voltages of L+ may be three, the number of the data voltage of H− is one and the number of the data voltage of H+ may be one.

The ratio between the number of the high frame data voltage H and the number of the low frame data voltage L of the first and fourth pixels PA may be 1:3 during the first to eighth frames. Thus, the low frame may be sufficient to improve the side visibility.

In addition, the number of the positive high frame data voltages H+ and the number of the negative high frame data voltages H− of the first and fourth pixels PA are the same during the first to eighth frames. The number of the positive low frame data voltages L+ and the number of the negative low frame data voltages L− of the first and fourth pixels PA are the same during the first to eighth frames. Thus, the display quality of the display apparatus may be stable.

The data voltages having a sequence of H+, L+, L−, L−, L+, L+, H−, L− are applied to the second and third pixels PB during the first to eighth frames, respectively. During eight frames, the number of the data voltages of L− is three, the number of the data voltages of L+ is three, the number of the data voltage of H− is one and the number of the data voltage of H+ is one.

The ratio between the number of the high frame data voltage H and the number of the low frame data voltage L of the second and third pixels PB may be 1:3 during the first to eighth frames. Thus, the low frames may be sufficient to improve the side visibility.

In addition, the number of the positive high frame voltages H+ and the number of the negative high frame voltages H− of the second and third pixels PB are the same during the first to eighth frames. The number of the positive low frame voltages L+ and the number of the negative low frame voltages L− of the second and third pixels PB are the same during the first to eighth frames. Thus, the display quality of the display apparatus may be stable.

Figure 6A:
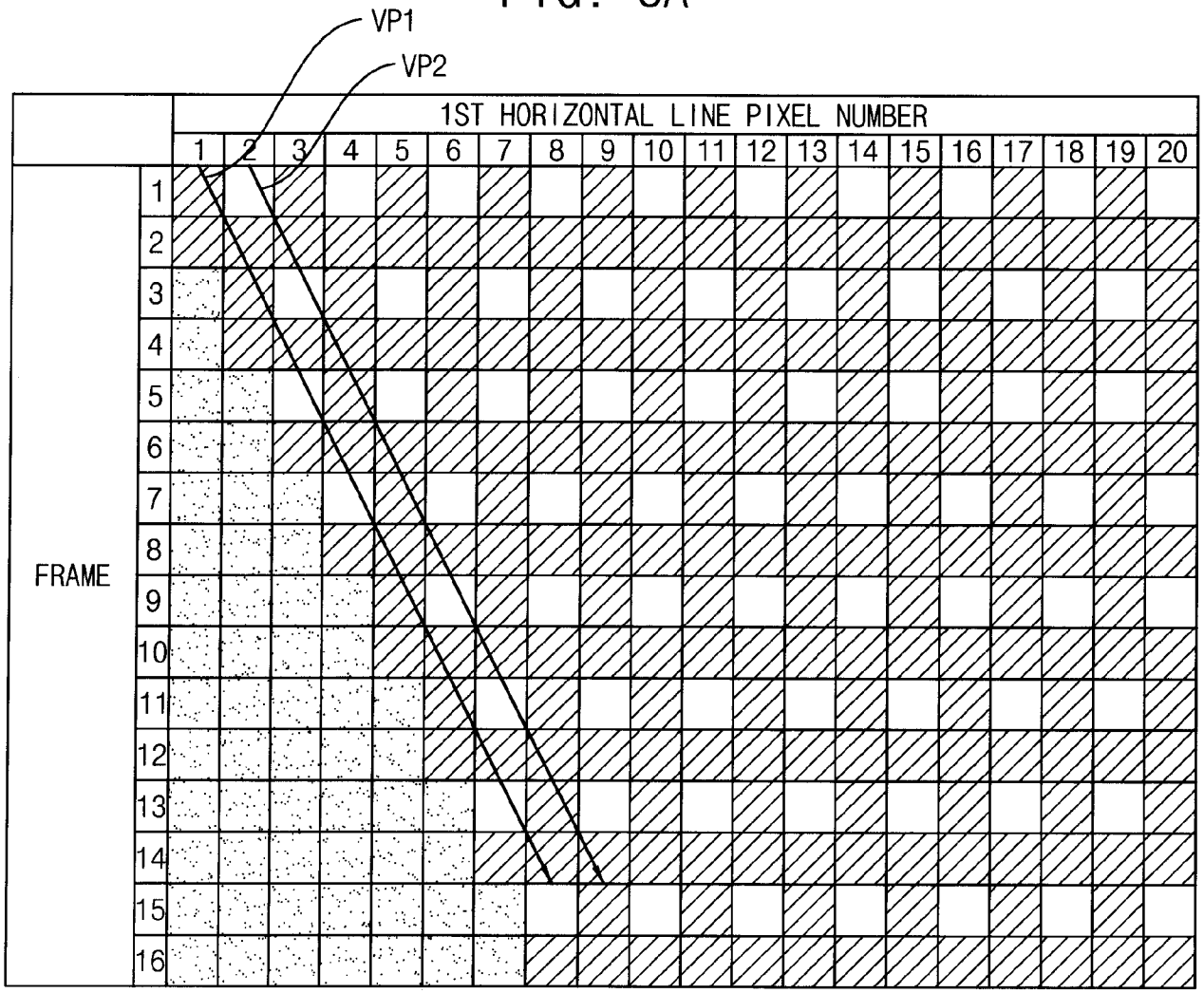
FIGS. 6A and 6B are conceptual diagrams illustrating a luminance of the pixel of the display panel of FIG. 1 when an object is displaced in a direction in an image.
Figure 6B:
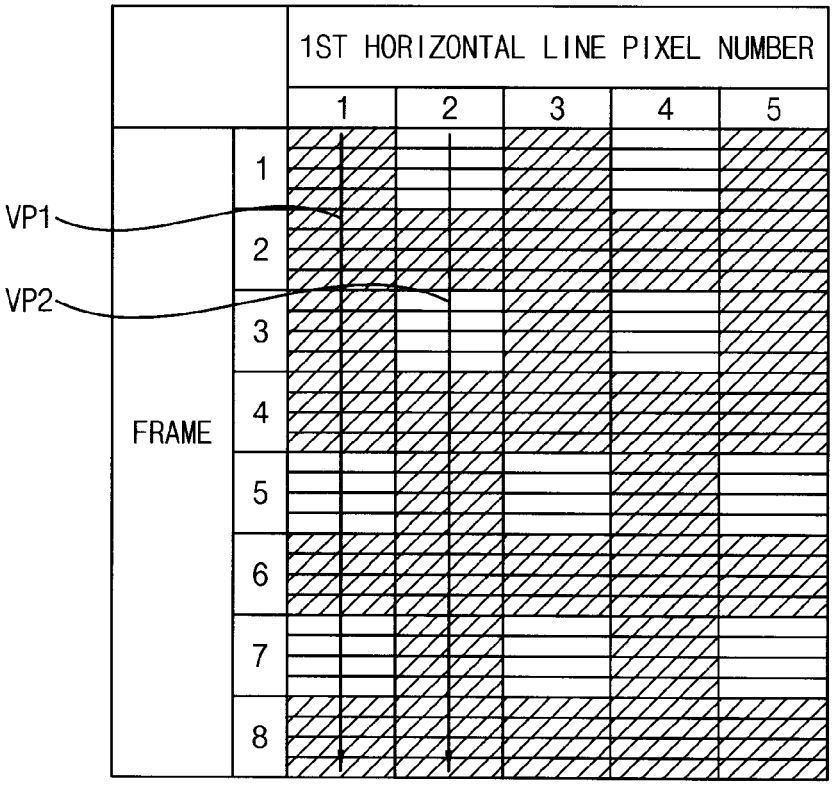

FIGS. 6A and 6B are conceptual diagrams illustrating a luminance of the pixel of the display panel 100 of FIG. 1 when an object is displaced in a direction in an image.

In FIGS. 6A and 6B, the object in the image is displaced in a velocity of 0.5 pixels/frame. The viewer's viewpoint follows the object according to human optical characteristics.

In FIGS. 6A and 6B, a white box represents a pixel displaying high data voltage H and a box filled with inclined lines represents a pixel displaying low data voltage L.

In FIG. 6A, a first row represents the pixels in the first pixel row during the first frame, a second row represents the pixels in the first pixel row during the second frame, a third row represents the pixels in the first pixel row during the third frame and a fourth row represents the pixels in the first pixel row during the fourth frame.

When the object is displaced in the image, the viewpoint of the viewer is moved in a velocity same as the velocity of the object in the image of 0.5 pixels/frame. When the object is displaced in the image, a moving checker artifact may be generated due to luminance difference of the image according to the viewer's viewpoint.

In FIG. 6B, when the viewer views the image in a first viewpoint VP1 during first to eighth frames, the high data voltage is shown to the viewer during two frames and the low data voltage is shown to the viewer during six frames. In addition, when the viewer views the image in a second viewpoint VP2 during first to eighth frames, the high data voltage is shown to the viewer during two frames and the low data voltage is shown to the viewer during six frames.

The average luminance of the image in the first viewpoint VP1 during the first to eighth frames is substantially the same as the average luminance of the image in the second viewpoint VP2 during the first to eighth frames. Accordingly, the moving checker artifact may not be generated in the present exemplary embodiment. Thus, the display quality of the display apparatus may be improved.

Thus, in the display panel 100 having the alternate pixel array and driven in a two frame inversion method, a sequence of the high data voltages and the low data voltages is determined so that the side visibility may be improved and the moving checker artifact may be prevented.

Figure 7:
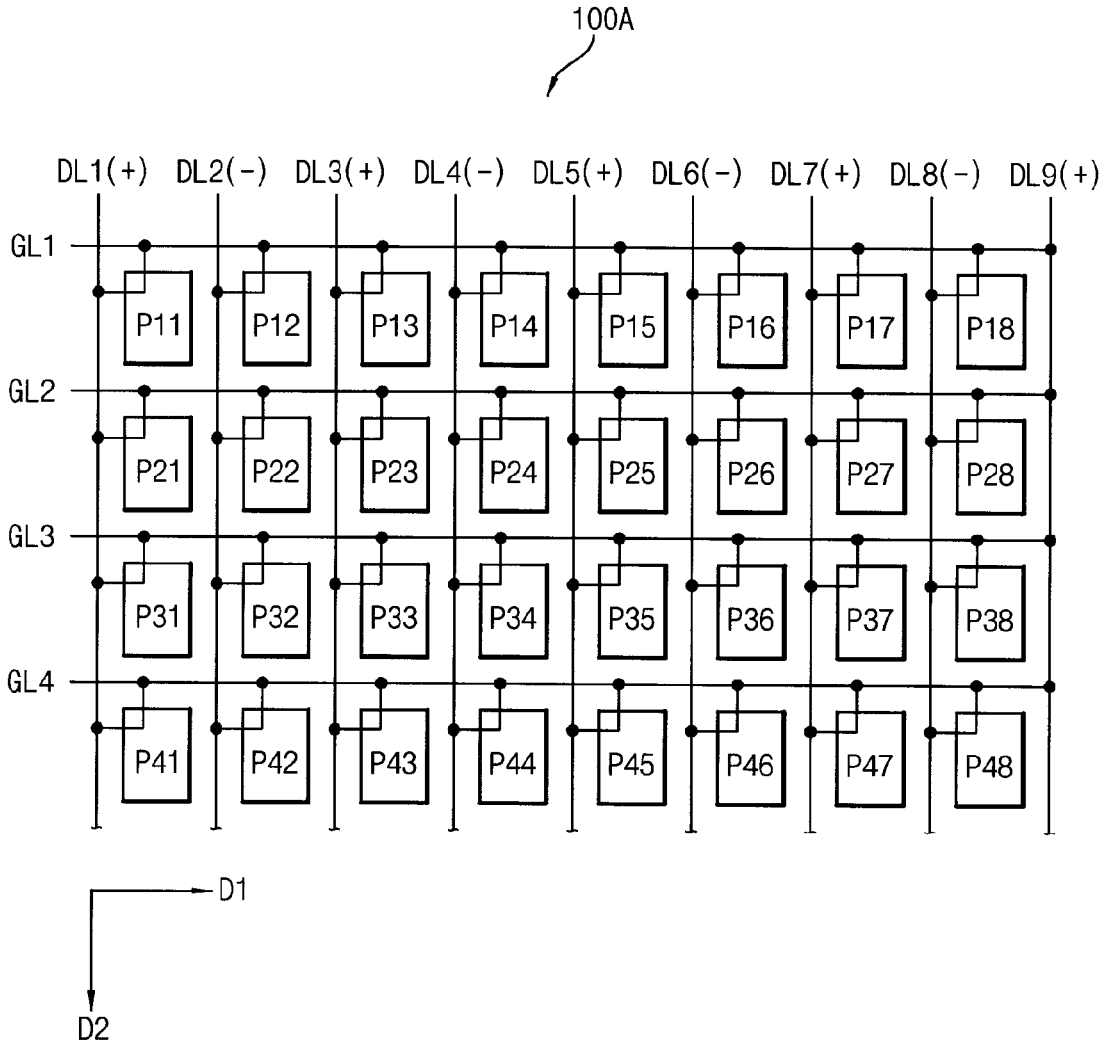
FIG. 7 is a plan view illustrating a pixel array of a display panel of a display apparatus according to an exemplary embodiment of the present invention.

FIG. 7 is a plan view illustrating a pixel array of a display panel 100A of a display apparatus according to an exemplary embodiment of the present invention.

The display apparatus according to the present exemplary embodiment is substantially the same as the display apparatus of the previous exemplary embodiment explained referring to FIGS. 1 to 6B except that the display panel 100A has a non-alternate pixel array and the pixels of the display panel 100A are inverted in every four frames. Thus, the same reference numerals will be used to refer to the same or like parts as those described in the previous exemplary embodiment of FIGS. 1 to 6B, and any repetitive explanation concerning the above elements will be omitted.

Referring to FIGS. 1 and 7, the display apparatus includes a display panel 100A and a panel driver. The panel driver includes a timing controller 200, a gate driver 300, a gamma reference voltage generator 400 and a data driver 500.

The display panel 100A has a non-alternating pixel array. The data lines of the display panel 100A are sequentially connected to the pixels in a pixel column.

Pixels P11 to P18 in a first pixel row are connected to a first gate line GL1. Pixels P21 to P28 in a second pixel row are connected to a second gate line GL2. Pixels P31 to P38 in a third pixel row are connected to a third gate line GL3. Pixels P41 to P48 in a fourth pixel row are connected to a fourth gate line GL4.

Pixels P11, P21, P31 and P41 in a first pixel column are sequentially connected to a first data line DL1. Pixels P12, P22, P32 and P42 in a second pixel column are sequentially connected to a second data line DL2. Pixels P13, P23, P33 and P43 in a third pixel column are sequentially connected to a third data line DL3. Pixels P14, P24, P34 and P44 in a fourth pixel column are sequentially connected to a fourth data line DL4.

Data voltages having a positive polarity are applied to the first, third, fifth, seventh and ninth data lines DL1, DL3, DL5, DL7, and DL9. Data voltages having a negative polarity are applied to the second, fourth, sixth and eighth data lines DL2, DL4, DL6, and DL8. Thus, the pixels in the display panel 100A may be inverted in a unit of one column according to the first direction D1. The polarity of the data voltages of the first to ninth data lines DL1 to DL9 may be inverted in every four frames.

Figure 8A:
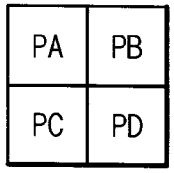
FIG. 8A is a plan view illustrating a pixel group of the display panel of FIG. 7.
Figure 8B:
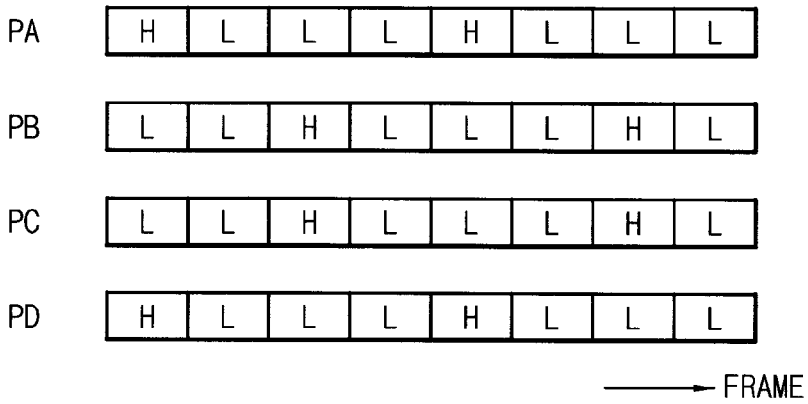
FIGS. 8B and 8C are conceptual diagrams illustrating a sequence of output image data applied to the pixel group of FIG. 8A.
Figure 8C:
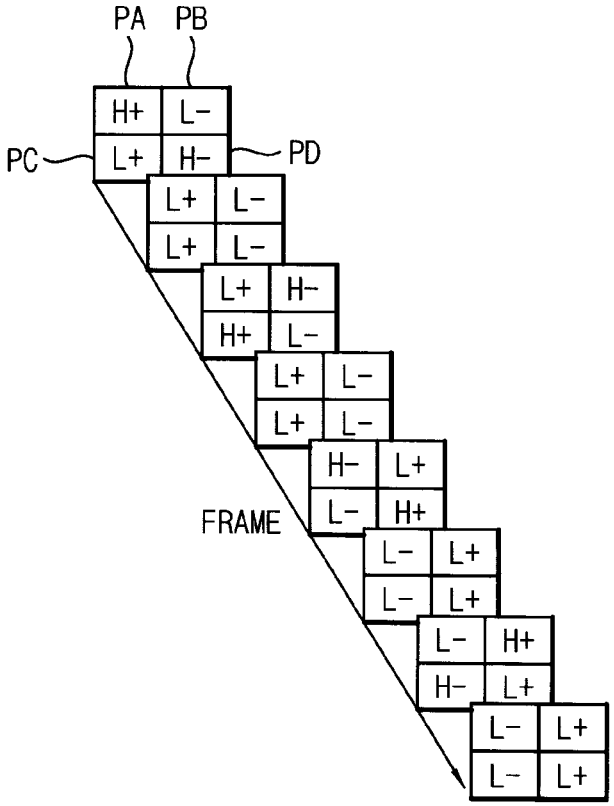

FIG. 8A is a plan view illustrating a pixel group of the display panel 100A of FIG. 7. FIGS. 8B and 8C are conceptual diagrams illustrating a sequence of output image data applied to the pixel group of FIG. 8A.

Referring to FIGS. 1, 3, 5, 7, and 8A to 8C, the display panel 100A includes a pixel group including four pixels in a two by two matrix.

In an exemplary embodiment, the pixel group includes a first pixel PA in a first row and a first column, and a second pixel PB in the first row and a second column which is adjacent to the first pixel PA in the first direction D1. The pixel group further includes a third pixel PC in a second row and the first column which is adjacent to the first pixel PA in the second direction D2, and a fourth pixel PD in the second row and the second column which is adjacent to the second pixel PB in the second direction D2.

When the high data voltage is applied to the first pixel PA, the high data voltage is applied to the fourth pixel PD. When the low data voltage is applied to the first pixel PA, the low data voltage is applied to the fourth pixel PD. The first pixel PA and the fourth pixel PD form a data pixel group.

When the high data voltage is applied to the second pixel PB, the high data voltage is applied to the third pixel PC. When the low data voltage is applied to the second pixel PB, the low data voltage is applied to the third pixel PC. The second pixel PB and the third pixel PC form a data pixel group.

As explained referring to FIG. 7, the display panel 100A has a non-alternating pixel array. For example, a first data line is connected to the first pixel PA and the third pixel PC in the pixel group. A second data line is connected to the second pixel PB and the fourth pixel PD in the pixel group.

Referring to FIG. 8B, a high data voltage H is applied to the first to fourth pixels PA, PB, PC and PD during a frame of every four frames and a low data voltage L is applied to the first to fourth pixels PA, PB, PC and PD during three of every four frames.

In the present exemplary embodiment, a ratio of the number of the high frames to the number of the low frames is 1:3, so that the low data voltage L may be sufficiently displayed to the viewer even though the falling response of the liquid crystal is relatively slow.

The high data voltage H and the low data voltage L patterns are repeatedly applied to the first to fourth pixels PA, PB, PC, and PD every eight frames.

For example, the low data voltage L is applied to the first and fourth pixels PA and PD during second, third, fourth, sixth, seventh, and eighth frames and the high data voltage H is applied to the first and fourth pixels PA and PD during first and fifth frames. During the first to eighth frames, the data voltages having a sequence of H, L, L, L, H, L, L, L are applied to the first and fourth pixels PA and PD.

The low data voltage L is applied to the second and third pixels PB and PC during first, second, fourth, fifth, sixth, and eighth frames, and the high data voltage H is applied to the second and third pixels PB and PC during third and seventh frames. During the first to eighth frames, the data voltages having a sequence of L, L, H, L, L, L, H, L are applied to the second and third pixels PB and PC.

The low data voltage L is applied to the pixels PA, PB, PC, and PD of the display panel 100A simultaneously during at least one frame. In FIG. 8C, during the first frame and the third frame, the high data voltage H and the low data voltage L are selectively applied to the pixels of the display panel 100A. During the second frame and the fourth frame, the low data voltage L is simultaneously applied to the pixels of the display panel 100A.

In the present exemplary embodiment, when the first and fourth pixels PA and PD form a first data pixel group and the second and third pixels PB and PC form a second data pixel group, the high data voltage H is applied to the first data pixel group of the display panel 100A and the low data voltage L is applied to the second data pixel group of the display panel 100A during the first frame.

During a second frame, the low data voltage L is applied to the first data pixel group and the second data pixel group of the display panel 100A.

During a third frame, the low data voltage L is applied to the first data pixel group of the display panel 100A and the high data voltage H is applied to the second data pixel group of the display panel 100A.

During a fourth frame, the low data voltage L is applied to the first data pixel group and the second data pixel group of the display panel 100A.

The first to fourth pixels PA and PB may be inverted every four frames.

Referring to FIG. 8C, the data voltages having a sequence of H+, L+, L+, L+, H−, L−, L−, L− may be applied to the first pixel PA during the first to eighth frames, respectively. For the first pixel PA, during eight frames, the number of the data voltages of L− may be three, the number of the data voltages of L+ may be three, the number of the data voltage of H− is one and the number of the data voltage may be H+ is one.

The data voltages having a sequence of L−, L−, H−, L−, L+, L+, H+, L+ may be applied to the second pixel PB during the first to eighth frames, respectively. For the second pixel PB, during eight frames, the number of the data voltages of L− may be three, the number of the data voltages of L+ may be three, the number of the data voltage of H− is one and the number of the data voltage of H+ may be one.

The data voltages having a sequence of L+, L+, H+, L+, L−, L−, H−, L− may be applied to the third pixel PC during the first to eighth frames. For the third pixel PC, during eight frames, the number of the data voltages of L− may be three, the number of the data voltages of L+ may be three, the number of the data voltage of H− is one and the number of the data voltages of H+ may be one.

The data voltages having a sequence of H−, L−, L−, L−, H+, L+, L+, L+ may be applied to the fourth pixel PD during the first to eighth frames, respectively. For the fourth pixel PD, during eight frames, the number of the data voltages of L− may be three, the number of the data voltages of L+ may be three, the number of the data voltage of H− is one and the number of the data voltages of H+ may be one.

The ratio between the number of the high frame voltages H and the number of the low frame voltages L of the first to fourth pixels PA, PB, PC, and PD is 1:3 during the first to eighth frames. Thus, the low frame may be sufficient to improve the side visibility.

In addition, the number of the positive high frame voltages H+ and the number of the negative high frame voltages H− of the first to fourth pixels PA, PB, PC, and PD are the same during the first to eighth frames. The number of the positive low frame voltages L+ and the number of the negative low frame voltages L− of the first to fourth pixels PA, PB, PC, and PD are the same during the first to eighth frames. Thus, the display quality of the display apparatus may be stable.

Figure 9A:
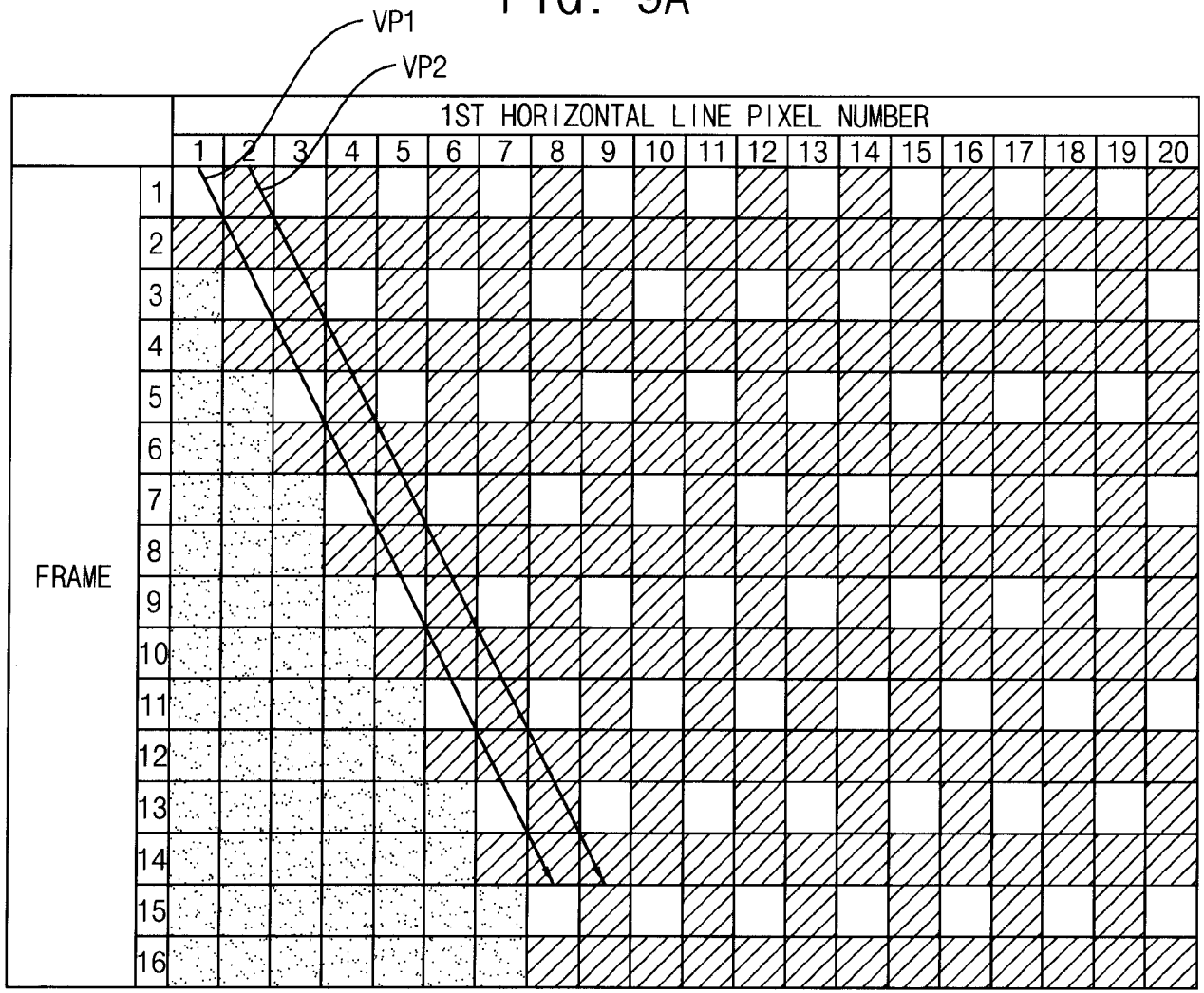
FIGS. 9A and 9B are conceptual diagrams illustrating a luminance of the pixel of the display panel of FIG. 7 when an object is displaced in a direction in an image.
Figure 9B:
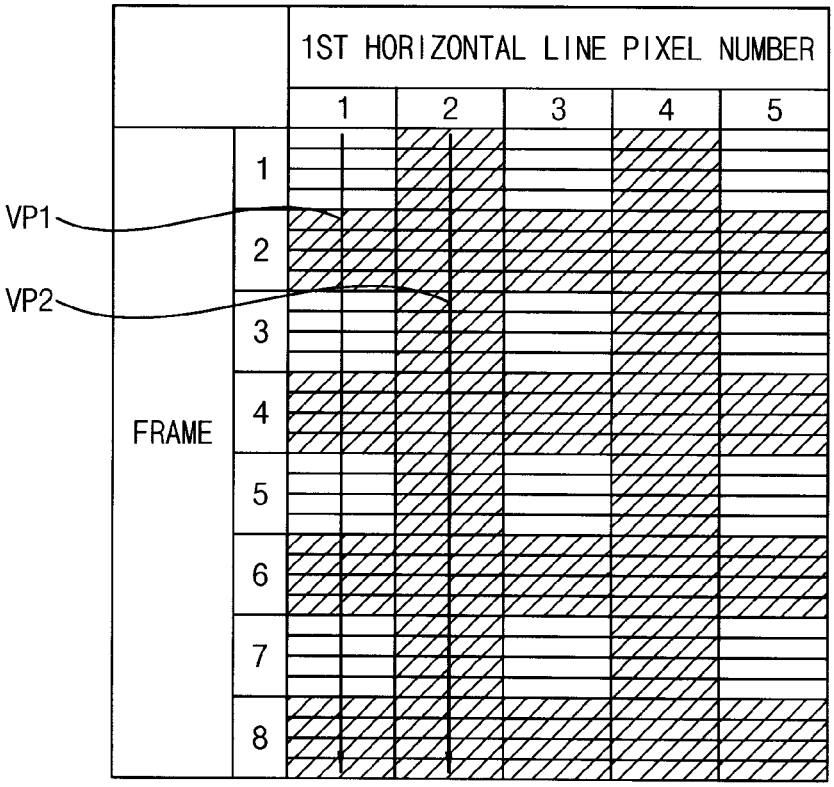

FIGS. 9A and 9B are conceptual diagrams illustrating a luminance of the pixel of the display panel 100A of FIG. 7 when an object is displaced in a direction in an image.

In FIGS. 9A and 9B, the object in the image is displaced in a velocity of 0.5 pixel/frame. A viewer's viewpoint follows the object according to human optical characteristics.

In FIGS. 9A and 9B, a white box represents a pixel displaying high data voltage H and a box filled with inclined lines represents a pixel displaying low data voltage L.

In FIG. 9B, when the viewer views the image in a first viewpoint VP1 during the first to eighth frames, the high data voltage is shown to the viewer during four frames and the low data voltage is shown to the viewer during four frames. When the viewer views the image in a second viewpoint VP2 during first to eighth frames, the high data voltage is not shown to the viewer and the low data voltage is shown to the viewer during eight frames.

The average luminance of the image in the first viewpoint VP1 during the first to eighth frames is greater than the average luminance of the image in the second viewpoint VP2 during the first to eighth frames. However, difference between the average luminance of the image in the first viewpoint VP1 during the first to eighth frames and the average luminance of the image in the second viewpoint VP2 during the first to eighth frames is decreased compared to a conventional display panel. Accordingly, the moving checker artifact may not be generated in the present exemplary embodiment. Thus, the display quality of the display apparatus may be improved.

Thus, in the display panel 100A having the non-alternating pixel array and driven in a four frame inversion method, a sequence of the high data voltages and the low data voltages is properly determined so that the side visibility may be improved and the moving checker artifact may be prevented.

According to the present invention as explained above, the side visibility may be improved and the moving checker artifact may be prevented. Thus, the display quality of the display apparatus may be improved.

The foregoing is illustrative of the present invention and is not to be construed as limiting thereof. Although a few exemplary embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the appended claims. The present invention is defined by the following claims, with equivalents of the claims to be included therein.

What is claimed is:

1. A method of driving a display panel, the method comprising:

generating a high data voltage having a high gamma corresponding to a grayscale of input image data;

generating a low data voltage having a low gamma less than the high gamma corresponding to the grayscale of the input image data; and outputting the high data voltage and the low data voltage to pixels of a display panel, wherein:

of the high data voltage and the low data voltage, only the low data voltage is outputted to all of the pixels of the display panel in at least one frame of a plurality of consecutive frames;

the high data voltage is outputted to a first data pixel group of the display panel and the low data voltage is out putted to a second data pixel group of the display panel in a first frame of four consecutive frames;

the low data voltage is outputted to the first data pixel group and the second data pixel group of the display panel in a second frame of the four consecutive frames;

the low data voltage is outputted to the first data pixel group of the display panel and the high data voltage is outputted to the second data pixel group of the display panel in a third frame of the four consecutive frames; and the low data voltage is outputted to the first data pixel group and the second data pixel group of the display panel in a fourth frame of the four consecutive frames.

2. The method of claim 1, wherein the high data voltage is outputted to a pixel among the pixels of the display panel in one of every four frames and the low data voltage is outputted to the pixel among the pixels of the display panel in three of every four frames.

3. The method of claim 2, wherein the display panel comprises:

a first pixel;

a second pixel adjacent to the first pixel in a first direction;

a third pixel adjacent to the first pixel in a second direction;

a fourth pixel adjacent to the second pixel in the second direction;

a first data line electrically connected to the first pixel;

a second data line electrically connected to the second pixel and the third pixel; and a third data line electrically connected to the fourth pixel.

4. The method of claim 3, wherein a polarity of a data voltage applied to the second pixel is opposite to a polarity of a data voltage applied to the first pixel, a polarity of a data voltage applied to the third pixel is opposite to the polarity of the data voltage applied to the first pixel, and a polarity of a data voltage applied to the fourth pixel is the same as the polarity of the data voltage applied to the first pixel.

5. The method of claim 3, wherein the low data voltage is applied to the first pixel during first, second, fourth, sixth, seventh, and eighth frames of eight consecutive frames, and the high data voltage is applied to the first pixel during third and fifth frames of the eight consecutive frames.

6. The method of claim 5, wherein the low data voltage is applied to the second pixel during the second, third, fourth, fifth, sixth, and eighth frames of the eight consecutive frames, and the high data voltage is applied to the second pixel during the first and seventh frames of the eight consecutive frames.

7. The method of claim 6, wherein the polarities of the data voltages applied to the first pixel and the second pixel are inverted every two frames of the eight consecutive frames.

8. The method of claim 2, wherein the display panel comprises:

a first pixel;

a second pixel adjacent to the first pixel in a first direction;

a third pixel adjacent to the first pixel in a second direction;

a fourth pixel adjacent to the second pixel in the second direction;

a first data line electrically connected to the first pixel and the third pixel; and a second data line electrically connected to the second pixel and the fourth pixel.

9. The method of claim 8, wherein a polarity of a data voltage applied to the second pixel is opposite to a polarity of a data voltage applied to the first pixel, a polarity of a data voltage applied to the third pixel is the same as the polarity of the data voltage applied to the first pixel, and a polarity of a data voltage applied to the fourth pixel is opposite to the polarity of the data voltage applied to the first pixel.

10. The method of claim 8, wherein the low data voltage is applied to the first pixel during second, third, fourth, sixth, seventh, and eighth frames of eight consecutive frames, and the high data voltage is applied to the first pixel during first and fifth frames of the eight consecutive frames.

11. The method of claim 10, wherein the low data voltage is applied to the second pixel during the first, second, fourth, fifth, sixth, and eighth frames of the eight consecutive frames, and the high data voltage is applied to the second pixel during the third and seventh frames of the eight consecutive frames.

12. The method of claim 11, wherein polarities of the data voltages applied to the first pixel and the second pixel are inverted every four frames of the eight consecutive frames.

13. A display apparatus, comprising:

a data driver configured to generate a high data voltage having a high gamma corresponding to a grayscale of input image data and a low data voltage having a low gamma less than the high gamma corresponding to the grayscale of the input image data; and a display panel comprising pixels configured to receive the high data voltage and the low data voltage, wherein:

of the high data voltage and the low data voltage, the data driver is configured to output only the low data voltage to the pixels of the display panel in at least one frame of a plurality of consecutive frames;

a first data pixel group of the display panel is configured to receive the high data voltage and the second data pixel group of the display panel is configured to receive the low data voltage in a first frame of the four consecutive frames;

the first data pixel group and the second data pixel group of the display panel is configured to receive the low data voltage in a second frame of the four consecutive frames;

the first data pixel group of the display panel is configured to receive the low data voltage and the second data pixel group of the display panel is configured to receive the high data voltage in a third frame of the four consecutive frames; and the first data pixel group and the second data pixel group of the display panel are configured to receive the low data voltage in a fourth frame of the four consecutive frames.

14. The display apparatus of claim 13, wherein one of the pixels of the display panel is configured to receive the high data voltage in one of every four frames and to receive the low data voltage in three of every four frames.

15. The display apparatus of claim 14, wherein the display panel comprises:

a first pixel;

a second pixel adjacent to the first pixel in a first direction;

a third pixel adjacent to the first pixel in a second direction;

a fourth pixel adjacent to the second pixel in the second direction;

a first data line electrically connected to the first pixel;

a second data line electrically connected to the second pixel and the third pixel; and a third data line electrically connected to the fourth pixel, wherein the first pixel is configured to receive the low data voltage in the first, second, fourth, sixth, seventh, and eighth frames of eight consecutive frames, and the first pixel is configured to receive the high data voltage in the third and fifth frames of the eight consecutive frames, and wherein the second pixel is configured to receive the low data voltage in the second, third, fourth, fifth, sixth, and eighth frames of the eight consecutive frames, and the second pixel is configured to receive the high data voltage in the first and seventh frames of the eight consecutive frames.

16. The display apparatus of claim 15, wherein polarities of the data voltages applied to the first pixel and the second pixel are inverted every two frames of the eight consecutive frames.

17. The display apparatus of claim 14, wherein the display panel comprises:

a first pixel;

a second pixel adjacent to the first pixel in a first direction;

a third pixel adjacent to the first pixel in a second direction;

a fourth pixel adjacent to the second pixel in the second direction;

a first data line electrically connected to the first pixel and the third pixel; and a second data line electrically connected to the second pixel and the fourth pixel, wherein the first pixel is configured to receive the low data voltage in the second, third, fourth, sixth, seventh, and eighth frames of eight consecutive frames, and the first pixel is configured to receive the high data voltage in the first and fifth frames of the eight consecutive frames, and wherein the second pixel is configured to receive the low data voltage in the first, second, fourth, fifth, sixth, and eighth frames of the eight consecutive frames, and the second pixel is configured to receive the high data voltage in the third and seventh frames of the eight consecutive frames.

18. The display apparatus of claim 17, wherein polarities of the data voltages applied to the first pixel and the second pixel are inverted every four frames of the eight consecutive frames.

* * * * *